US005367801A

United States Patent [19]

Ahn

[11] Patent Number: 5,367,801

[45] Date of Patent: Nov. 29, 1994

[54] MULTI-LAYER THREE-DIMENSIONAL DISPLAY

[76] Inventor: Young Ahn, 2627 N. Beachwood Dr., Los Angeles, Calif. 90068

[21] Appl. No.: 8,143

[22] Filed: Jan. 25, 1993

[51] Int. Cl.[5] ..... G09F 13/02

[52] U.S. Cl. ..... 40/152; 40/577

[58] Field of Search ..... 40/577, 578, 579, 160, 40/615, 152, 152.1, 152.2, 436; 472/72

[56] References Cited

U.S. PATENT DOCUMENTS

| | | | |
|---|---|---|---|
| 1,449,914 | 3/1923 | Saalburg . | |
| 1,465,564 | 8/1923 | Saalburg | 40/427 |
| 1,475,430 | 11/1923 | Curwen | 472/72 X |
| 2,208,001 | 7/1940 | Grant, Jr. | 40/152 X |
| 3,160,975 | 12/1964 | Malina | 40/436 |
| 3,236,368 | 2/1966 | Elsen . | |
| 3,455,045 | 7/1969 | Thomas | 40/615 |
| 3,829,998 | 8/1974 | Flax | 40/124.1 |
| 4,263,737 | 4/1981 | Simon | 40/577 X |

FOREIGN PATENT DOCUMENTS

| | | | |
|---|---|---|---|
| 949956 | 9/1949 | France | 40/152.2 |

*Primary Examiner*—Kenneth J. Dorner
*Assistant Examiner*—Joanne Silbermann
*Attorney, Agent, or Firm*—Ralph S. Branscomb

[57] ABSTRACT

A multi-layer three-dimensional display has three layers which are spaced apart in a common frame, with the front two being semi-transparent. Each layer is painted with a portion of an image, with the foreground details being on the front panel and the background on the back panel, etc. The central panel is a solid transparent sheet with the illustration applied thereto, and also being provided with a series of opaque, closely spaced light stripes. The front panel is preferably made of a screen similar to a window screen but could alternatively be a transparent sheet with or without a single grid of parallel lines. The display has an interior illumination means which cooperates with the visual effect of the front panel over the striped central panel in front of the opaque background panel to give the display a special shimmering effect and enhance its three-dimensional appearance.

4 Claims, 1 Drawing Sheet

38
36
10
14
16
18
20
22
34
12

36
38
12
3
3

22
32

32

18
24

26
20

30

MULTI-LAYER THREE-DIMENSIONAL DISPLAY

BACKGROUND OF THE INVENTION

The invention is in the field of fine art, although it could be easily applied to graphics and advertising images as well. More specifically, it relates to passive three-dimensional displays utilizing multiple layers spaced apart at different depths. Displays of this general nature are not new, and are represented by U.S. Pat. No. 3,829,998 issued to William E. Flax for a THREE-DIMENSIONAL DECORATIVE ITEM, and to P. R. Camp for a TRANSPARENT PICTURE. These devices utilize spaced overlays, each having different portions of the picture thereon with all but the back layer being transparent to produce a three-dimensional effect. The effect is three distinct depths, each having planar displays thereon.

In addition to this three-dimensional display, another genre is illustrated by two patents to C. W. Salburg, having U.S. Pat. Nos. 1,465,564 and 1,449,914. These devices are the forerunners of the currently popular holographic images which change as you move. The forerunner displays utilized series of parallel stripes in a frontal layer which ultimately align with parallel stripe groups of different pictures in the background as one moves, giving the impression that the picture is changing, or that the animal or other object displayed in the picture is moving as one wants to the left or right of the hanging picture.

Another type of three-dimensional picture is illustrated in U.S. Pat. No. 3,236,368, in which a contoured surface is provided with padding on other contourable medium.

These prior art devices do not rise to the level of fine art productions, but are rather artisan creations or novelty items. They do not produce any special effects or unexpected artistic results, but rather produce what one would expect of them based strictly on their physical composition.

SUMMARY OF THE INVENTION

The display of the instant invention, on the other hand, not only produces a three-dimensional effect, but also creates a special effect or effects which can only be appreciated by observing the completed unit. Although similar to the first group of prior art devices described having layers partial pictures on transparencies which superimpose on one another to the frontally observing viewer, the instant invention has specialized indicia on the intermediate panel and optionally the frontal panel, as well as interior lighting which cooperates with the special indicia, to produce not only an enhanced three-dimensional effect, but a sepalating, shimmering, mystical effect of misty depths as well.

To achieve these effects, the inventor/artist utilizes an opaque rear panel on which the background of a painting is reproduced, preferably as an original oil or acrylic painting or a limited production lithograph or silkscreen.

Spaced from the rear panel is an intermediate, semi-transparent panel which in the preferred embodiment is a Plexiglass$^{tm}$ layer with the middle ground of the painting applied to it. Also on the middle layer is an array of closely spaced parallel light-colored stripes.

The frontal semi-transparent panel has three alternative forms. It can be an open screen grid made from windowscreen material or something similar. Windowscreen material is dark and flat-finished so that no glare is reflected from it, and it has the foreground of the painting applied to it.

Alternatively the front panel could be a sheet of stretched film or a rigid transparent sheet like the intermediate panel, either clear or covered with vertical stripes similar to the vertical grid filaments of a windowscreen.

A light between the frontal and intermediate layers, near the bottom of the frame that houses all of the panels, illuminates the front two panels and the rear panel through the intermediate panel. Because the stripes of the intermediate are light colored, they tend to stand out. The screen of the front panel in the screen embodiment, being preferably black and flat-finished, tends to disappear from the viewer as such, but nonetheless has the effect of aligning and misaligning with the stripes of the intermediate layer spaced behind it, giving the picture a subtle, shimmering effect as one moves laterally slightly with respect to the painting. If the front panel is Plexiglass$^{tm}$ it is clear enough that the light can be omitted if desired.

In the preferred embodiment the rear two panels are angulated slightly such that when the rear panel is vertical the front panels are downwardly inclined to reduce the layer from above when viewed head-on.

DETAILED DESCRIPTION OF THE PREFERRED EMBODIMENT

Figures 1, 2, 3, 4, 5, 6, 7, 8:
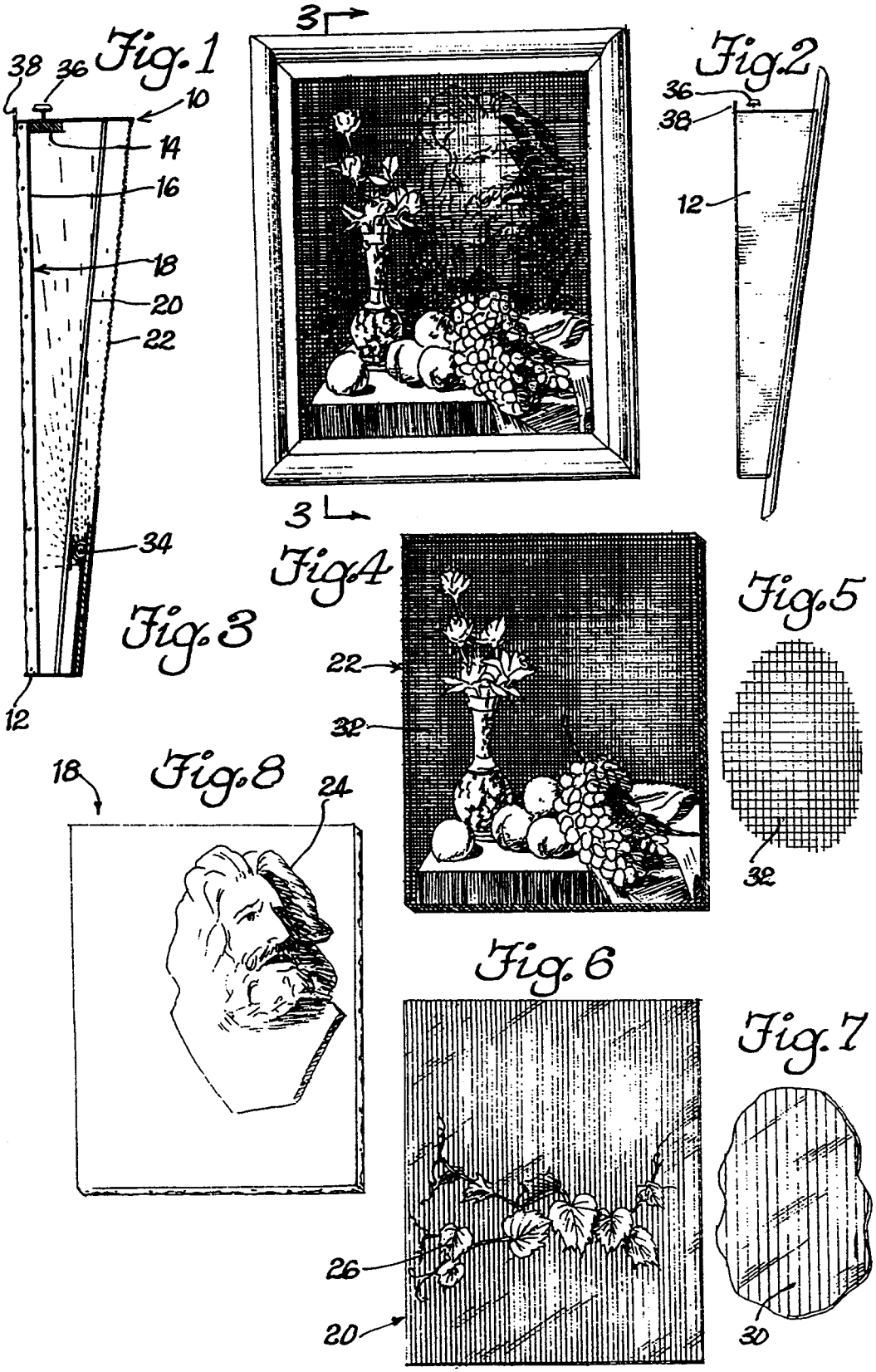
FIG. 1 is a front elevation view of the display.
FIG. 2 is a side elevation from the left view of the display as seen from the right side of FIG. 1.
FIG. 3 is a section taken along line 3—3 of FIG. 1 with the picture frame removed.
FIG. 4 is a front elevation view slightly in perspective illustrating the display only showing the illustration on the front panel.
FIG. 5 is an enlarged detail of the mesh screen of the frontal panel.
FIG. 6 is a front elevation view slightly in perspective of the semi-transparent intermediate panel illustrating the middle ground illustration thereof.
FIG. 7 is an enlarged detail of a portion of both an alternative embodiment of the frontal panel having only one set of parallel lines and the intermediate semi-transparent panel illustrating the stripe array; and, FIG. 8 is a front elevation view slightly in perspective of the opaque rear panel.

The display has a frame 10 which is rigid and could be made of a combination of plywood strips 12 and spacer members 14 as shown in FIG. 3. The details of construction of the frame are not important, provided they hold the display panels in the appropriate orientation. Also, it is desirable that the periphery of the display be completely opaque to prevent escape of the internal illumination means or the entrance of stray uncontrolled light.

As can be seen in FIG. 3, the frame also includes stretcher bars 16 for the rear panel 18, which in the preferred embodiment is made of canvas, and for the frontal a semi-transparent panel 22, if it is made of flexible material such as in the screen embodiment. The intermediate semi-transparent panel 20 which is made of Plexiglass$^{tm}$ or other rigid material needs no stretcher bars.

When used to describe the panels 20 and 22, the term "semi-transparent" is used. This is defined in this description as being anything that will transmit at least some light, whether it be a perfectly transparent sheet which is not completely transparent due to the painting on it, a transparent sheet with opaque or semi-opaque illustrations thereon, or a panel which is itself by nature semi-transparent or translucent.

The rear panel 18 has a background illustration 24 painted or otherwise illustrated on its front surface. The rear panel is canvas. Some of the illustration on the rear panel will always be visible to the viewer, and other portions will be hidden to one degree or another behind the more forward layers of illustration, depending from what angle the display is viewed.

The intermediate semi-transparent panel 20 is preferably solid, transparent and rigid. Glass or Plexiglass$^{tm}$ fit this description, and no doubt other materials could be used as well. Also, this layer could be made of a flexible polyethylene sheeting or the like stretched on a frame, with the same effect being achieved.

The illustration on the intermediate layer is shown in FIG. 6. In this particular example, grape leaves are illustrated as indicated at 26. The grape leaves 26 appear to the viewer to be in front of the background 24.

The frontal panel 22 has the illustration shown in FIG. 4 applied across its surface, which is its front surface in the preferred embodiment. Of course anything on the front surface will be foreground material. As the observer moves back and forth, or up and down for that matter, the three-dimensional is achieved by parallax as the different layers move back and forth relative to more rearward layers.

The display as described thus far is not materially different from prior art displays as described in the background utilizing three spaced overlays. However, beyond the above-described structure is an array of closely spaced, parallel lines 30 applied to the face of the intermediate panel 20 as illustrated in FIGS. 6 and 7. In the screen embodiment, cooperating with this array of stripes is line grid of the screen filaments of the front panel. A similar effect can be achieved by using Plexiglas$_{tm}$ covered either with a reticulated screen-like grid or a parallel vertical stripe array similar to that on the intermediate panel. The screen grid relates to the array of stripes by having spacings between the screen filaments which are half the spacing between the stripes in the strip array. The thickness of the stripes is on the order of the same thickness as the filaments of the screen grid 32. By being spaced twice as far apart as the screen grid filaments, the stripes are more visible and produce a more striking effect to the observer.

An illumination means, in the form of an elongated incandescent bulb 34 is mounted near the bottom of the frame between the frontal and intermediate panels as shown in FIG. 1. This bulb illuminates virtually everything in the display, directly illuminating the intermediate panel and the rear side of the front panel and illuminating the rear panel through the intermediate panel. If the frontal panel is screen the light is almost essential, but if it is a clear sheet it can be used without the light as it admits so much more illumination than the screen.

The stripes 30 on the intermediate panel are white or otherwise light colored and thus stand out quite well in the illumination. The front screen embodiment on the other hand, is a dark, flat-finished screen material which tends to disappear. The combination of these two effects produce a shimmering, mystical effect as one moves even slightly as the display is observed. The front screen is subtle in itself as it tends to be invisible, but nonetheless alternately interacts with the white stripes and transparent inter-stripe spaces of the intermediate panel to produce the special effect. Any particular point of view from in front of the display the angle of incident rays from the stripes is different, forming a slightly converging cone, meaning that they are never all covered or all exposed at the same time.

As shown in FIG. 3, the frame is constructed in the preferred embodiment so that there is a slight V-shape to the display and cross-section. The "V" is formed between the intermediate and rear panels, with the intermediate and front panels being parallel so that the effects of the shifting parallel lines is maintained. If the front and intermediate panels both had parallel stripe arrays and diverged, from any angle other than exactly head-on the stripes and vertical screen grid lines would not be parallel. The purpose of the V-shape is to slant the face of the display downwardly slightly to reduce the tendency of lights or other illumination from the above to create glare on the surface of the painting, inasmuch as the flat, dark feature of the front screen is important to the overall effect.

The illustrations on the individual panels are created as follows. On the rear panel, which is canvas, simple painting, silk screening, or printing with a lithographic process can be used. The same is true on the central panel. The front panel, however, if made of screen, must have a preliminary layer of some type of sealant to fill the spaces between the screen grid where the image is going to be applied. In the model of the preferred embodiment, a transparent acrylic layer was applied after an outline of the image was drawn on the screen. Then, another outline of the final illustration was applied to the acrylic, and the final illustration painted painstakingly on the transparent acrylic layer. In limited production, this would be done by sequential lithographic or silkscreen processes in all likelihood.

For purposes of the claims, the configuration of the panels in FIG. 3 is considered to be "substantially parallel" to one another, as is any orientation between two adjacent panels which permit the rearmost panel to be seen through the adjacent forward panel.

Although only three layers are shown in the instant disclosure, clearly other layers could be added to produce additional three-dimensional effects. The shape of the frame, the materials of the frame, the angulation or parallelism of the panels relative to one another, the type and location of the illustrating light, the positioning of the stripes on one semi-transparent panel or the other semi-transparent panel, are all subject to modification within the intended scope of the amended claims. The essence of the invention is the provision of a three-dimensional, multi-layer display utilizing a rear panel and two (or more) semi-transparent forward panels, with at least the intermediate panel defining an array of parallel stripes to create the special effect produced by the display as viewed through the two forward layers to the rear panel.

It is hereby claimed:

1. A multi-layered display comprising:

(a) a frame;

(b) a rear panel, an intermediate semi-transparent panel, and a frontal semi-transparent panel, said panels being mounted in said frame in mutually spaced and substantially parallel relation;

(c) each of said panels having a frontally visible visual presentation such that when said display is viewed from the front of the visual presentation of all three panels are superimposed together;

(d) at least one of said semi-transparent panels defining an opaque grid of spaced parallel lines substantially spanning the respective panel to provide an enhanced sense of depth in said display;

(e) said grid being comprised of two sets of spaced parallel lines with one set being perpendicular to and overlying the other set, and said at least one of said semi-transparent panels defining said opaque grid and another of said panels defining an array of spaced parallel stripes parallel with the lines of one of said sets of parallel grid lines;

(f) said stripes being spaced apart twice as far as said grid lines;

(g) said frontal semi-transparent panel defining said grid of lines and said grid lines being a dark light-absorbent color and said stripes are of a bright, light-reflective color and said grid lines are flat-finished to avoid reflective glare;

(h) said frontal semi-transparent panel substantially comprising an open screen and said lines are defined by two spaced parallel filament sets, with the filaments of the set being mutually perpendicular; and including a sealing layer defined on said screen behind the visual presentation on said frontal panel with said presentation being applied onto said sealing layer.

2. A display according to claim 1 wherein said filaments in each set of parallel filament sets are spaced apart on the order of 1/16th inch on center and said stripes are spaced apart on the order of twice as far as said filaments.

3. A multi-layered display comprising:

(a) a frame;

(b) a rear panel, an intermediate semi-transparent panel, and a frontal semi-transparent panel, said panels being mounted in said frame in mutually spaced and substantially parallel relation;

(c) each of said panels having a frontally visible visual presentation such that when said display is viewed from the front of the visual presentation of all three panels are superimposed together;

(d) at least one of said semi-transparent panels defining an opaque grid of spaced parallel lines substantially spanning the respective panel to provide an enhanced sense of depth in said display;

(e) said grid being comprised of two sets of spaced parallel lines with one set being perpendicular to and overlying the other set, and said at least one of said semi-transparent panels defining said opaque grid and another of said panels defining an array of spaced parallel stripes parallel with the lines of one of said sets of parallel grid lines;

(f) said stripes being spaced apart twice as far as said grid lines said frontal semi-transparent panel defining said grid of lines; and (g) said grid lines being a dark light-absorbent color and said stripes are of a bright, light-reflective color and said grid lines are flat-finished to avoid reflective glare;

(h) said frontal semi-transparent panel substantially comprising an open screen and said lines are defined by two spaced parallel filament sets, with the filaments of the set being mutually perpendicular; and, (i) including illumination means is disposed between said frontal semi-transparent panel and said intermediate semi-transparent panel said rear panel is opaque, and including illumination means being disposed between two of said panels.

4. A multi-layered display comprising:

(a) a frame;

(b) a rear panel, an intermediate semi-transparent panel, and a frontal semi-transparent panel, said panels being mounted in said frame in mutually spaced and substantially parallel relation;

(c) each of said panels having a frontally visible visual presentation such that when said display is viewed from the front of the visual presentation of all three panels are superimposed together;

(d) at least one of said semi-transparent panels defining an opaque grid of spaced parallel lines substantially spanning the respective panel to provide an enhanced sense of depth in said display;

(e) said grid being comprised of two sets of spaced parallel lines with one set being perpendicular to and overlying the other set, and said at least one of said semi-transparent panels defining said opaque grid and another of said panels defining an array of spaced parallel stripes parallel with the lines of one of said sets of parallel grid lines;

(f) said stripes being spaced apart twice as far as said grid lines said frontal semi-transparent panel defining said grid of lines; and (g) said grid lines being a dark light-absorbent color and said stripes are of a bright, light-reflective color and said grid lines are flat-finished to avoid reflective glare;

(h) said frontal semi-transparent panel substantially comprising an open screen and said lines are defined by two spaced parallel filament sets, with the filaments of the set being mutually perpendicular; and, (i) illumination means is disposed between said front semi-transparent panel and said intermediate semi-transparent and being positioned to illuminate said semi-transparent panels directly, and said rear panel through said intermediate semi-transparent panels.

* * * * *